US006050043A

United States Patent [19]

Rosenblat et al.

[11] Patent Number: 6,050,043

[45] Date of Patent: Apr. 18, 2000

[54] APPARATUS AND METHOD FOR SUPPORTING CONCRETE BEAMS, WALLS AND THE LIKE

[75] Inventors: Michael L. Rosenblat, Winnipeg; Timothy J. Isles, Leamington; Louis C. Dufault, Winnipeg, all of Canada

[73] Assignee: Void Form International Ltd., Canada

[21] Appl. No.: 09/070,301

[22] Filed: Apr. 30, 1998

Related U.S. Application Data

[60] Provisional application No. 60/072,000, Jan. 20, 1998.

[51] Int. Cl.[7] ..... E04G 15/06

[52] U.S. Cl. ..... 52/577; 249/61; 249/175; 249/DIG. 2; 29/469

[58] Field of Search ..... 52/720.1, 576, 52/577, 320; 249/DIG. 2, 61, 175, 176; 29/469; 493/391

[56] References Cited

U.S. PATENT DOCUMENTS

| | | | |
|---|---|---|---|
| 1,892,311 | 12/1932 | MacDonald . | |
| 2,881,501 | 4/1959 | Raney . | |
| 2,892,238 | 6/1959 | Budd | 249/175 |
| 2,916,909 | 12/1959 | Miller | 52/323 |
| 3,024,513 | 3/1962 | Shuxteau et al. . | |
| 3,109,217 | 11/1963 | Kell . | |
| 3,358,960 | 12/1967 | Oliver et al. . | |
| 3,512,747 | 5/1970 | Stark . | |
| 3,549,116 | 12/1970 | Ferry et al. . | |
| 3,857,217 | 12/1974 | Reps . | |
| 4,685,267 | 8/1987 | Workman . | |
| 4,827,690 | 5/1989 | Viger . | |

OTHER PUBLICATIONS

Gates SURE–VOID, Advertisement of Gates & Sons, Inc., Prior to May 29, 1996.

*Primary Examiner*—Michael Safavi
*Attorney, Agent, or Firm*—Piper, Marbury, Rudnick & Wolfe

[57] ABSTRACT

A completely closed and reinforced box-like structure for forming a void area in a concrete formation is constructed of a flat sheet that is scored with a plurality of parallel crease lines and features a side edge reinforcing panel. The reinforcing panel has a plurality of slots thereon. A plurality of interior and end pieces are slit scored so that they may be folded to provide interior and end support units. The support units define a plurality of spaced apart partitions having a plurality of slots and flat support surfaces thereon. The structure is assembled by initially folding the side edge reinforcing panel into a position generally normal to the flat sheet to define a longitudinal rib. The support units are then attached to the longitudinal rib by registering the slots in the partitions in interlocking relationship with corresponding slots on the rib. The support units are then rolled over to fold remaining panels of the sheet along the crease lines in wrapping relation around the support units and thus, the flat support surfaces. As a result, an enclosure with an interior chamber is defined wherein each of the support partitions substantially fills the cross-sectional area of the interior chamber and the flat support surfaces abut the enclosure. A pair of end panels cover the enclosure end openings so that the box-like structure is completely closed.

27 Claims, 7 Drawing Sheets

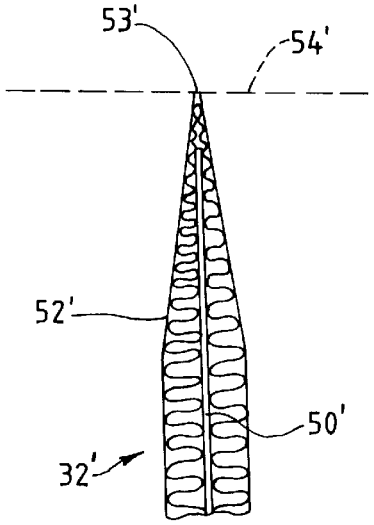
FIG. 7
PRIOR ART
FIG. 8
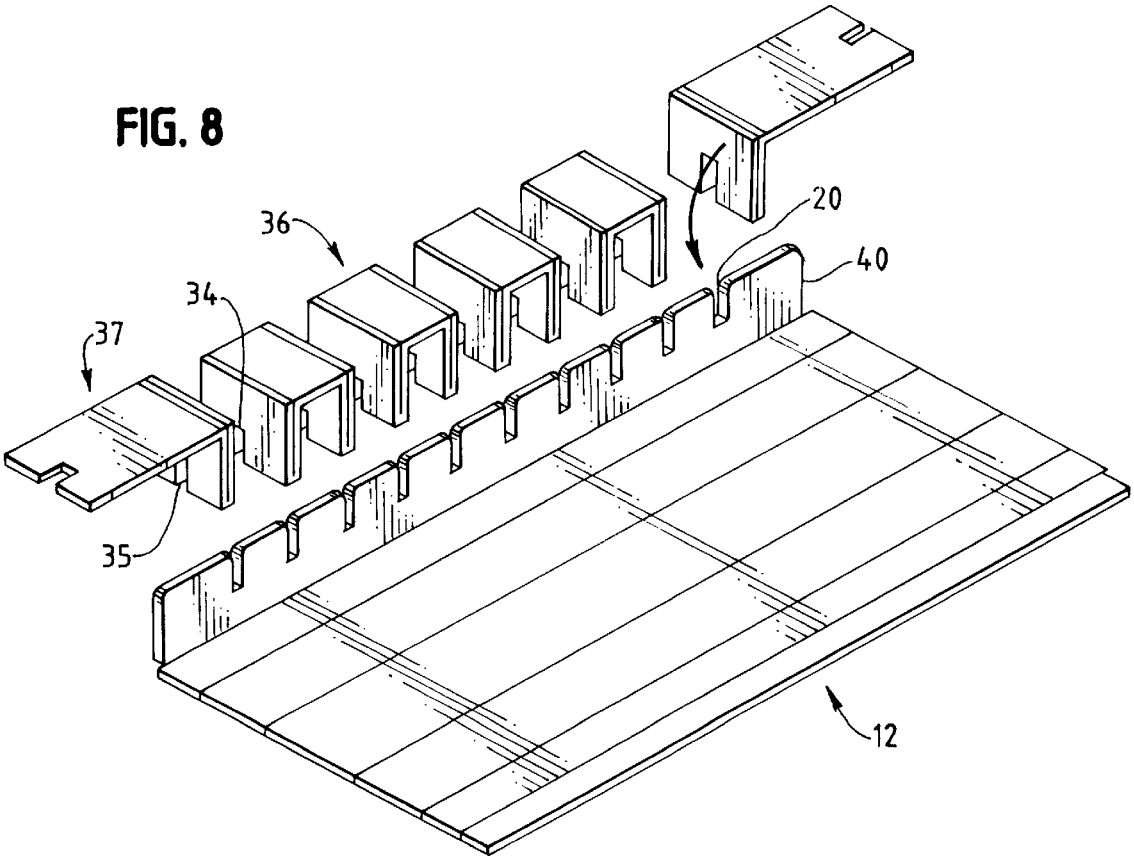

FIG. 13
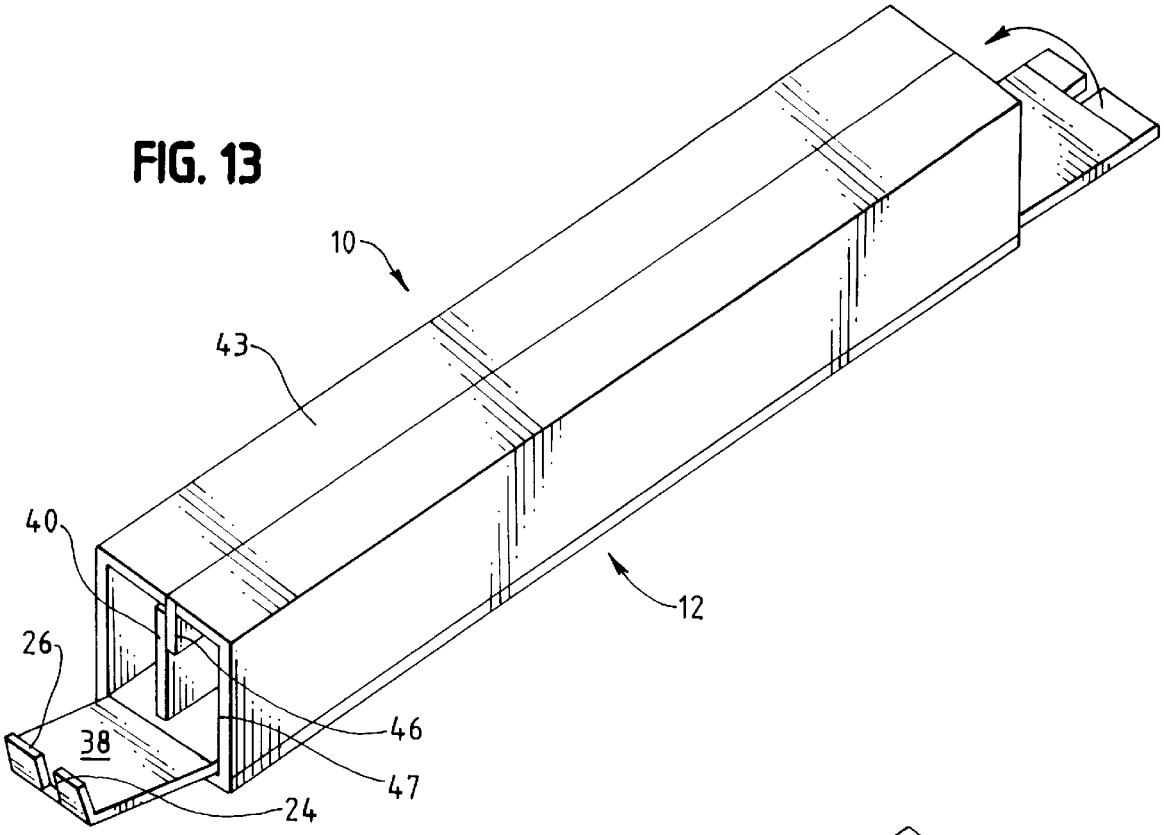
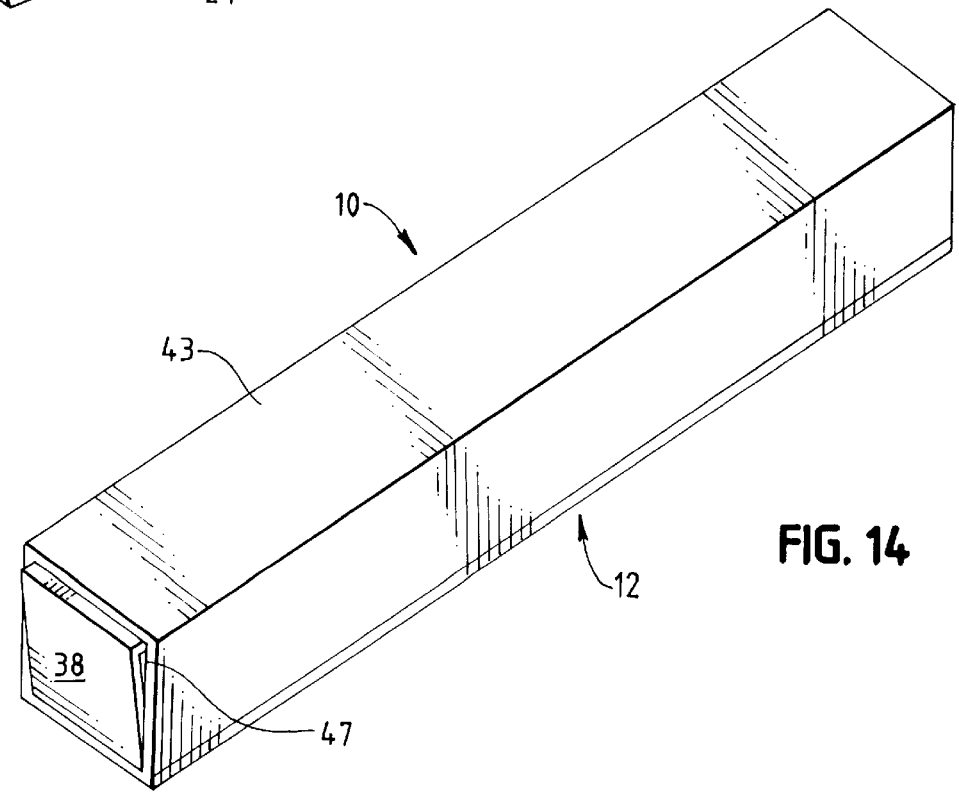
FIG. 14

APPARATUS AND METHOD FOR SUPPORTING CONCRETE BEAMS, WALLS AND THE LIKE

This application claims the benefit of U.S. Provisional Application No. 60/072,000 filed Jan. 20, 1998.

FIELD OF THE INVENTION

The present invention relates generally to reinforced cardboard structures for creating voids in concrete formations, and more particularly, to a box-like structure capable of being assembled at a construction site and supporting a structural column or grade beam until the concrete dries and the box-like structure deteriorates, thereby creating a void in the concrete formation.

BACKGROUND OF THE INVENTION

It is commonly known in the construction industry to create spaces or voids in or under various types of concrete formations. For example, concrete formations below grade such as the structural foundation of a building often require a space or void between the foundation and the ground to accommodate expansion of the soil, thereby preventing damage to the foundation. Thus, it is often desirable to create a void between the structural floor and/or grade beams of a foundation and the underlying soil to accommodate upheaval of the soil. It may also be desirable to create a void between the walls of a foundation and the surrounding soil to accommodate a similar expansion of the soil below grade. In addition, voids can also be utilized above grade between cement floor slabs to reduce the amount of cement required and to make the resulting slab lighter.

Another type of concrete formation that sometimes requires a void is a concrete pillar or column. It is often desirable to create a void in a pillar or column to allow room for internal plumbing, electrical conduits or the like within the column. By forming a void in the column, the items within the column are protected and the cost of making the column can be reduced because less concrete is required.

Typically, these voids are created by placing a biodegradable support structure made of corrugated cardboard in the desired location. These support structures are configured to support the building structural components until the poured concrete is capable of holding its own weight. As the concrete dries, and as the cardboard eventually deteriorates, a void is left in the concrete formation. However, such support structures are typically difficult to assemble and often can only be assembled at a factory and transported to a construction site.

Support structures featuring a main wrapping sheet with separate individual insert sections have been known. While these support structures could be assembled at the construction site, they provided an unsatisfactory compressive strength. Of the many features which in combination provided the overall compressive strength, FIG. 7 shows the prior art triangular shaped peaks that served as interior supports for the support structure side walls (see dashed line 54' in FIG. 7). Such triangular peaks offered low compressive strength and thus adversely effected the quantity of concrete that could be supported by the support structure.

Another feature of the prior art structure included interior walls assembled from single sections of paperboard. The paperboard sections were folded to provide double thickness walls and single thickness walls.

Heretofore known support structures that could be assembled on site also featured ends that were open. This proved undesirable as it provided the very ends of the support structure surfaces with little or no support. In addition, such an arrangement provided an additional possible entry point for wet concrete. This was very undesirable as when the interior cardboard became wet, it lost virtually all of its strength.

Accordingly, it is an object of the present invention to provide a box-like structure that may be either delivered factory assembled to the construction site, or delivered in a "knocked-down" configuration for easy assembly and installation on site.

It is another object of the present invention to provide a box-like structure with a high compressive strength.

It is another object of the present invention to provide a box-like structure that prevents the leakage of liquid concrete into its interior.

It is still another object of the present invention to provide a box-like structure that is capable of being assembled in an efficient manner.

SUMMARY OF THE INVENTION

In view of the above, and in accordance with the present invention, there is provided a method of making a reinforced box-like structure for forming a void area in a concrete formation. A flat sheet of corrugated cardboard or similar material is scored with a plurality of parallel crease lines. A side edge reinforcing panel is also provided. The reinforcing panel has a plurality of slots thereon extending generally perpendicularly relative to the crease lines. A plurality of interior and end support units made of corrugated paper are provided separate from the flat sheet and feature a plurality of crease lines and slit scores. The support units define a plurality of spaced apart partitions having a plurality of slots and flat support surfaces thereon.

Each support unit is formed by folding a flat piece of material along parallel crease and slit score lines to define a plurality of spaced apart partitions with each featuring a flat support surface. The support units are formed so that the partitions have double-thickness walls that are separated by slit scoring. Also, the slots on the double-walled partitions are initially defined as slits extending transversely across the slit scoring on the flat pieces of material. Thus, the flat pieces of material are folded such that panel sections on each side of the slit scoring move into side by side relationship to define the double-walled partitions with flat support surfaces. The slits transverse to the slit scores are thereby also folded in half to form unitary insertion slots extending approximately one half the height of the double-walled partitions.

The structure is assembled by initially folding the side edge reinforcing panel into a position generally normal to the flat sheet to define a longitudinal rib. The support units are then attached to the longitudinal rib by registering the slots in the partitions in interlocking relationship with corresponding slots on the rib, wherein the partitions extend transversely relative to said rib. The support units are then rolled over to fold remaining panels of the sheet along the crease lines in wrapping relation around the support units and thus, the flat support surfaces. Thus, an enclosure with an interior chamber is defined wherein each of the support partitions substantially fill the cross-sectional area of the interior chamber. In addition, the flat support surfaces abut the enclosure. This provides the support structure with increased strength so that an appropriate quantity of concrete may be supported thereby.

After the remaining panels of the flat sheet have been wrapped around the support units, a locking side flap of the sheet opposite the reinforcing side flap is tucked adjacent the rib. In addition, the pair of end support units feature end panels that are folded inward to cover the ends of the box-like structure. Locking end flaps, positioned on each of the end panels, are tucked so that their end slots engage the ends of the longitudinal rib and the locking side flap. As a result, the box-like structure is completely closed so as to prevent the entry of wet cement. This allows the cardboard within the structure to remain dry and strong.

The present invention provides significant advantages over other void forming box-like structures. The support units with flat support surfaces may be easily assembled and releasably attached to the longitudinal rib of the cardboard sheet to provide internal strength for the structure. The connection of the support units to the rib also allows the overall box-like structure to be easily formed by rolling or "wrapping" the panels of the sheet around the support units. Thus, the completely closed box-like structures can be delivered factory assembled to the construction site, or they can be delivered in a "knocked-down"configuration for easy assembly and installation on site. Mechanical fasteners are not required to assemble the completely closed box-like structures, which are typically in the form of a beam or floor structure.

The present invention, together with further objects and advantages, will be best understood by reference to the following detailed description taken in conjunction with the accompanying drawings.

BRIEF DESCRIPTION OF THE DRAWINGS

FIG. 7 is a partial end elevation view of a partition of a prior art device;

FIG. 8 is a perspective view of the box-like structure of the present invention with the support units oriented to operably interconnect to a longitudinal rib of the sheet;

FIGS. 13 and 14 are perspective views showing the end panels being folded and the locking end flaps being inserted to close the box-like structure.

DETAILED DESCRIPTION OF THE PREFERRED EMBODIMENT

Figure 1:
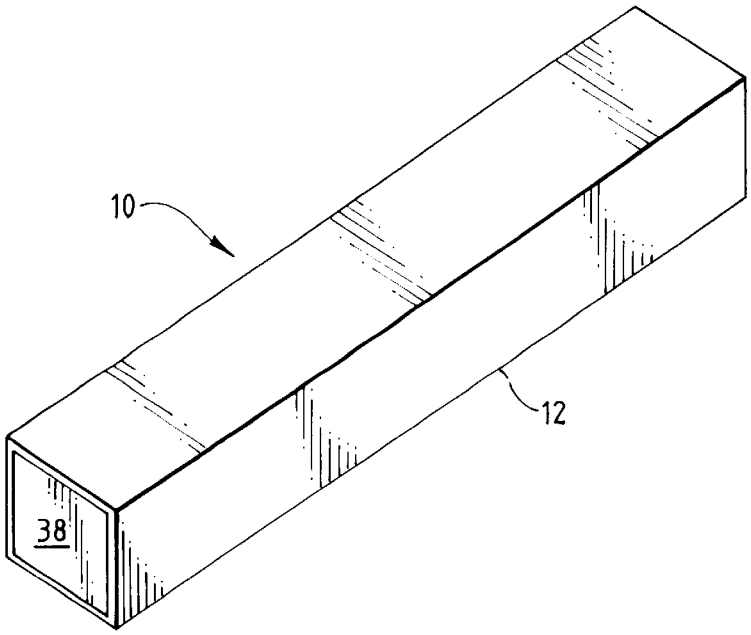
FIG. 1 illustrates a top perspective view of a box-like structure completely assembled in accordance with the present invention.

While the present invention is susceptible of embodiment in various forms, there is shown in the drawings and will hereinafter be described a preferred embodiment of the invention with the understanding that the present disclosure is to be considered as setting forth an exemplification of the invention which is not intended to limit the invention to the specific embodiment illustrated.

Referring now to the drawings, wherein like reference numerals refer to like parts throughout the several views, there is shown in FIG. 1 a reinforced box-like structure 10 for forming a void area in a concrete formation (not shown). Although only a single box-like structure 10 is shown in FIG. 1, it will be understood by those having ordinary skill in the art that in a typical construction site, a plurality of box-like structures substantially identical to the structure 10 would be placed underneath grade beams of a building foundation to support substantially the entire weight of the grade beams when the concrete is initially poured.

Figure 2:
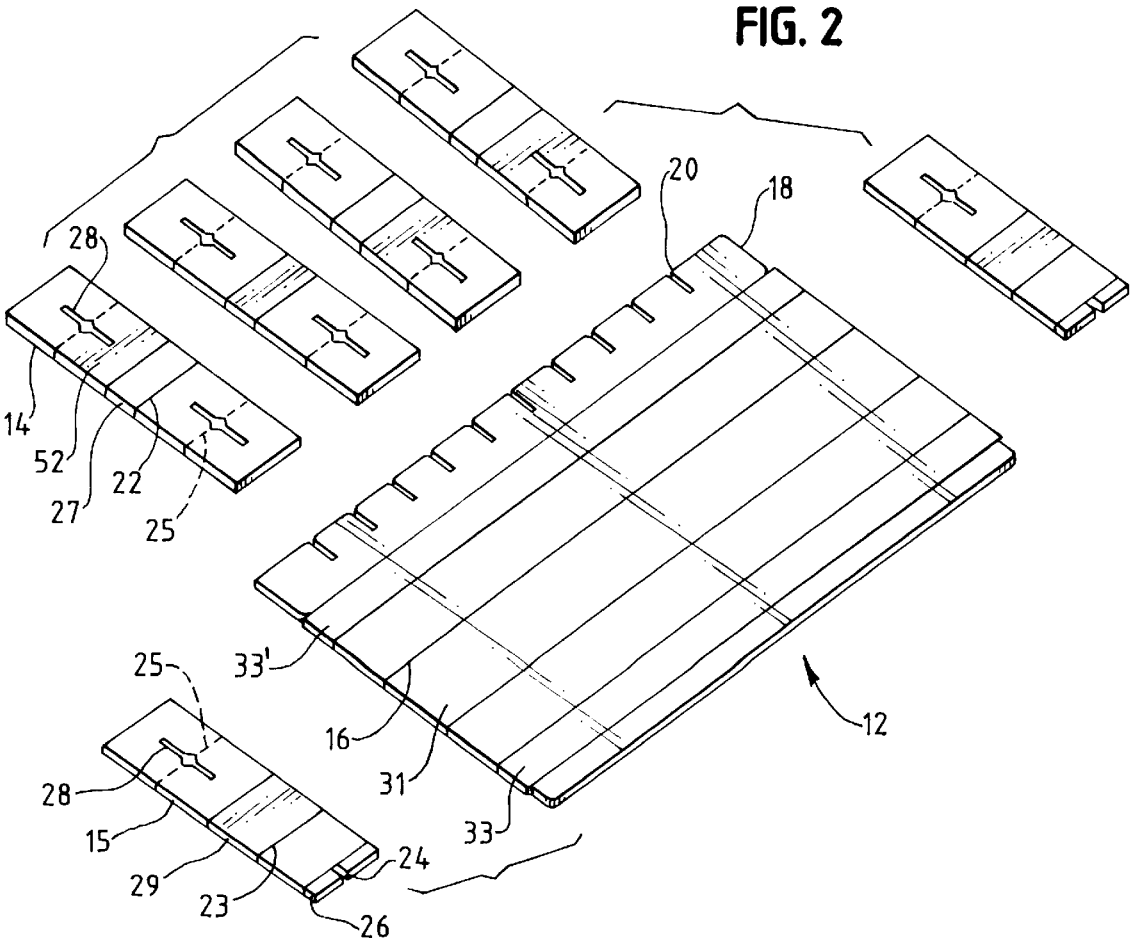
FIG. 2 is a top perspective view showing a plurality of flat generally planar pieces of material such as cardboard that are cut and creased in relation to each other prior to assembly.

Referring now to FIG. 2, the structure is initially formed from a rectangular, flat outer sheet 12, a plurality of rectangular, flat interior pieces 14 and a plurality of rectangular, flat end pieces 15 of a semi-rigid material. Preferably, the outer sheet 12, interior pieces 14 and end pieces 15 are made of corrugated paperboard. To facilitate folding, the outer sheet 12 is scored with a plurality of parallel crease lines 16 that define three adjacent side panels 31 as well as a first half-side panel 33 and a second half-side panel 33'. The outer sheet 12 also has a side edge reinforcing panel 18 with a plurality of evenly spaced slots 20 thereon which extend generally perpendicularly relative to the crease lines 16. Similarly, the flat interior and end pieces 14 and 15 are also scored with a plurality of parallel crease lines 22 and 23 thereon that define interior bridge panels 27 and end bridge panels 29 and facilitate folding. A transverse end slot 24 is also formed in a locking end flap 26 on each end piece 15. Transverse slits 28 are formed in each interior piece 14 as well as in the two end pieces 15. As will be discussed in more detail below, the slits 28 in the interior and end pieces 14 and 15 are ultimately manipulated to register with the slots 20 in the outer sheet reinforcing panel 18.

Figure 3:
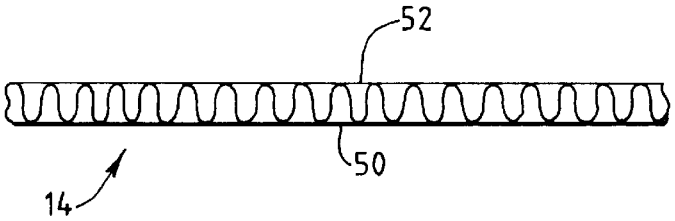
FIG. 3 is a partial end elevation view of an interior piece of FIG. 2.

Interior and end pieces 14 and 15 are also provided with slit scores, indicated by dashed lines 25. Referring to FIG. 3, interior pieces 14 feature inner layers 50 and outer layers 52. The slit scoring is accomplished by slitting the outer layers 52 along the paths indicated by dashed lines 25 in FIG. 2. The inner layers 50 are not slit. Slit scoring 25 is performed upon end piece 15 in the same manner.

Figure 4:
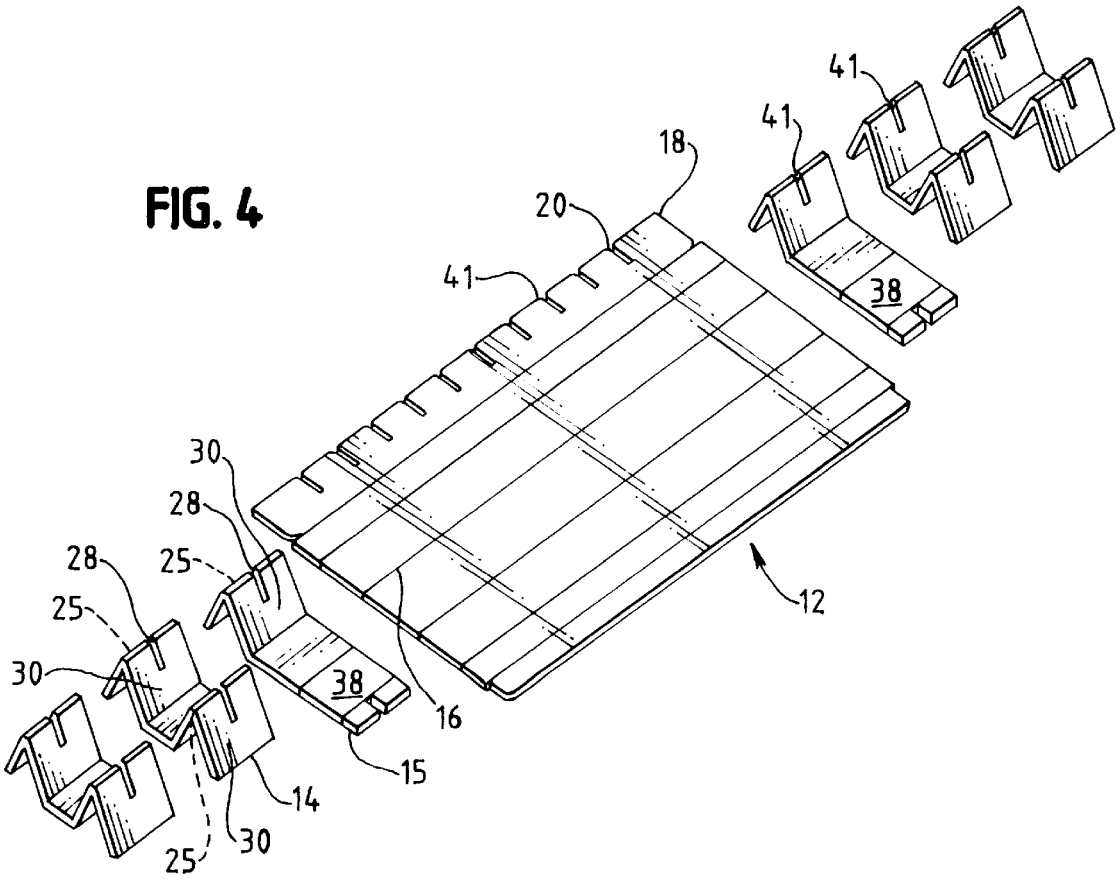
FIG. 4 is a top perspective view similar to FIG. 2 but showing flat auxiliary pieces of material being folded along slit scores to create a plurality of support units defining spaced apart partitions.
Figure 5:
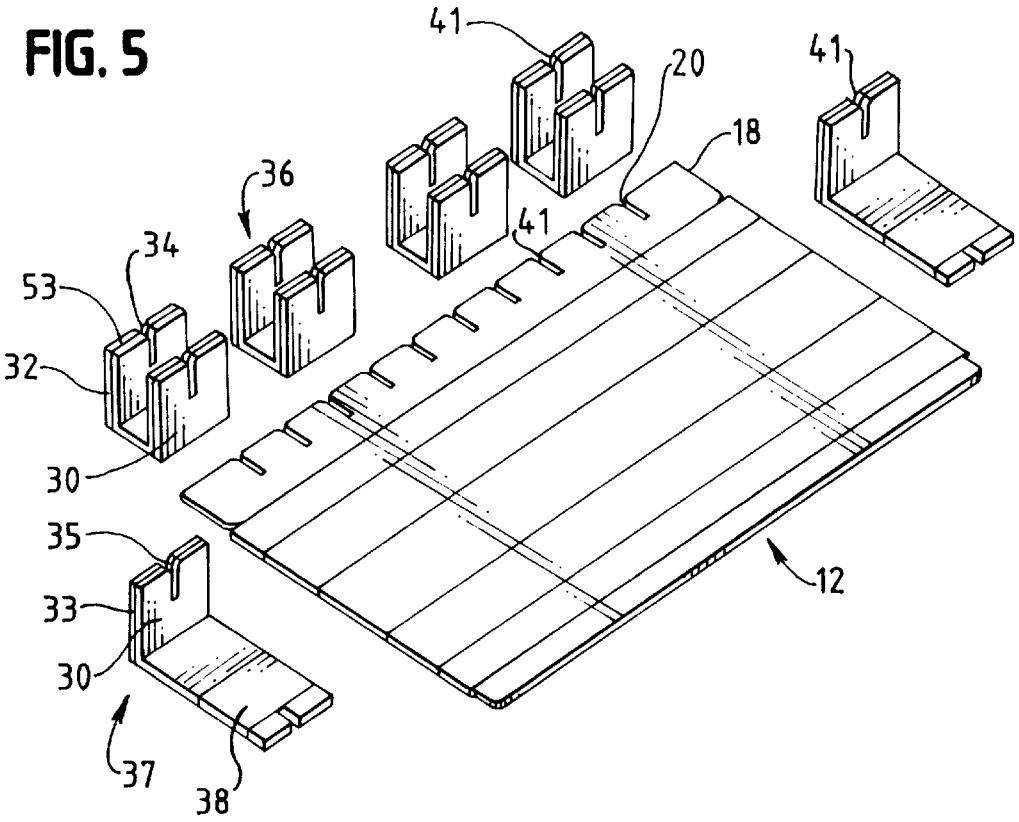
FIG. 5 is a perspective view similar to FIG. 4 but showing the support units in folded relation such that the partitions in each support unit have double-thickness walls.

As illustrated in FIGS. 4 and 5, the interior and end pieces 14 and 15 are folded so that panel sections 30 on each side of the slit scores 25 move into side by side relationship to define a plurality of double-thickness walls or partitions 32 and end partitions 33. The slits 28 on each slit score 25 are thereby also folded in half to form unitary insertion slots 34 and 35 extending approximately one half the height of the partitions 32 and 33. As a result, interior support units 36 and end support units 37 are defined. Each end support unit 37 is also configured with a single end panel 38 which, as will become apparent, defines a pair of single-thickness end walls.

Figure 6:
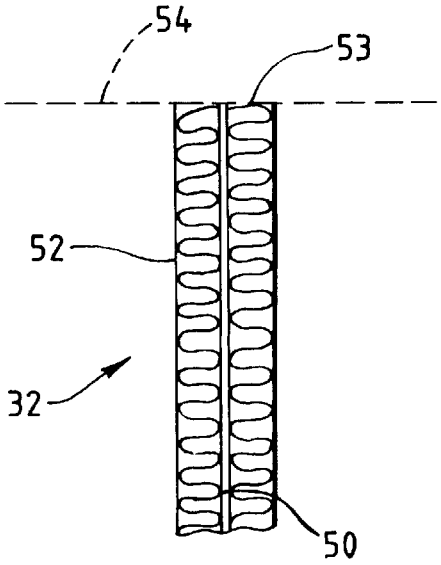
FIG. 6 is a partial end elevation view of a partition of FIG. 4.

As shown in FIG. 6, the slit scoring 25 allows partitions 32 (and likewise 33) to provide a flat support surface 53. As a result, partitions 32 and 33, and thus support units 36 and 37, are very effective at supporting heavy surfaces oriented in the manner indicated by dashed line 54. In contrast to the apparatus and method of the present invention, if slit scoring were not used, partitions 32 and 33 would have a profile as indicated in FIG. 7 at 32'. More specifically, the top portion of the partition would have the profile of a triangle with the apex forming the support surface 53'. Such an arrangement only allows a minimal load to be accommodated by surface 54' without the occurrence of buckling.

Figure 9:
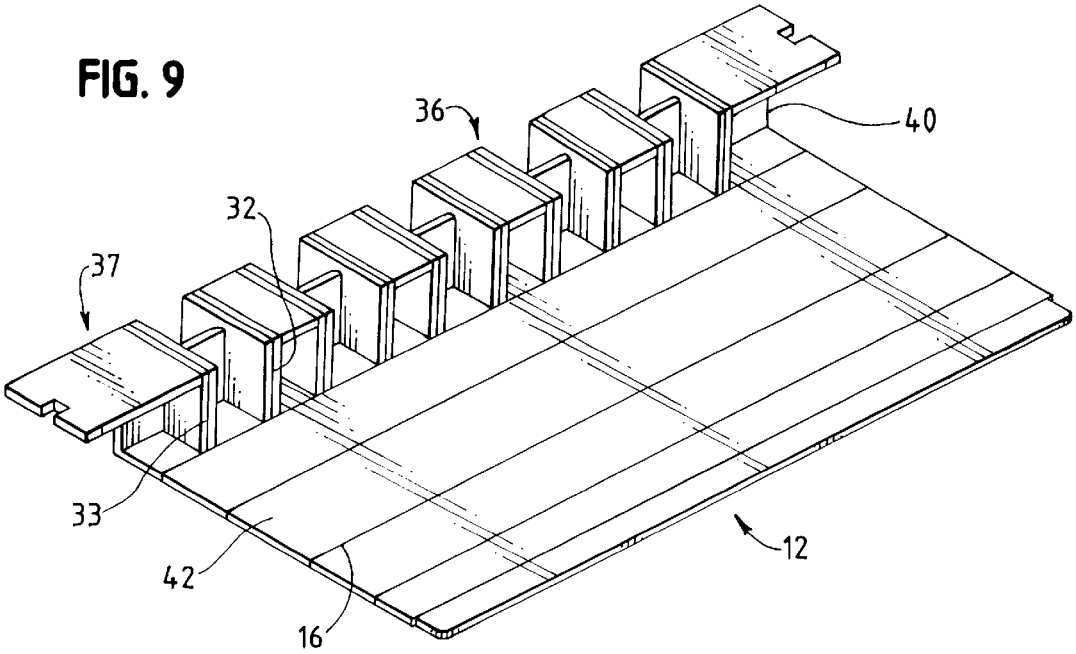
FIG. 9 is a perspective view showing assembly of the support units to the rib by registering insertion slots in the partitions with corresponding slots in the rib.

To begin assembly of the interior and end support units 36 and 37 to the outer sheet 12, the side edge reinforcing panel 18 (FIGS. 2, 4 and 5) is folded into a position generally normal to the flat outer sheet 12 to define a longitudinal rib 40 (FIG. 8). The interior and end support units 36 and 37 are then attached to the longitudinal rib 40 by registering the slots 34 and 35 into interlocking relationship with the corresponding slots 20 in the rib 40 (FIG. 9). Thus, the interior and end support units 36 and 37 are secured to the rib 40 and the partitions 32 and 33 extend transversely relative to the rib 40.

As will be appreciated, the slots 20 in the rib 40 have a thickness substantially the same as the overall thickness of the partitions 32 and 33, and the slots 34 in the partitions 32 have a thickness substantially the same as the thickness of the rib 40. To facilitate registration of the partitions 32 and 33 with rib 40, the slots 20, 34 and 35 each have a chamfer region 41 on the top of each slot 20, 34 and 35. (FIGS. 4 and 5).

Figure 10:
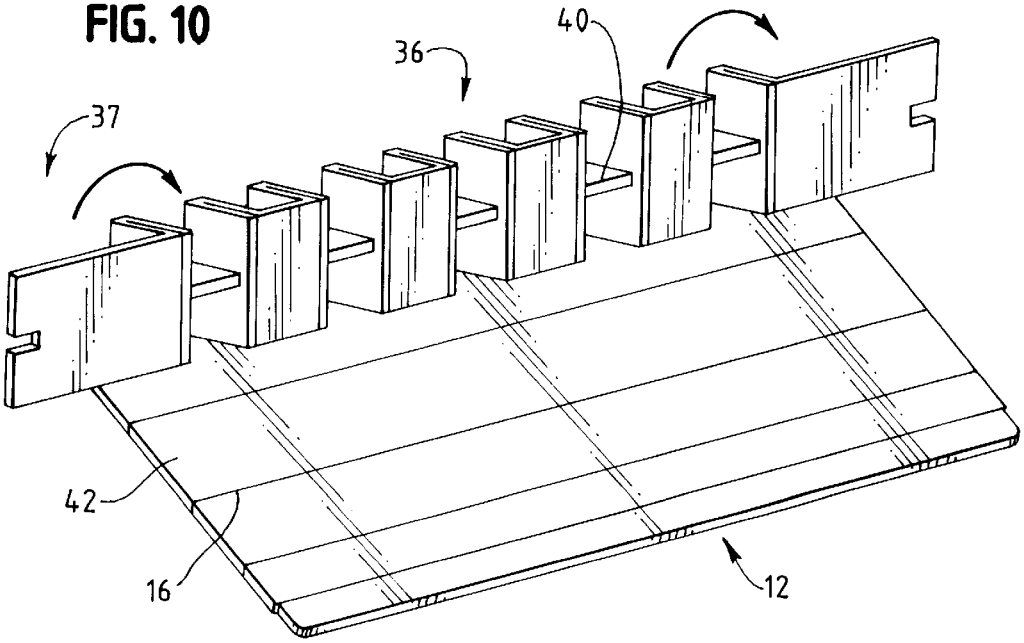
FIGS. 10 and 11 are perspective views showing the assembled support units being rolled over so that the remaining panels of the sheet wrap around the support units.
Figure 11:
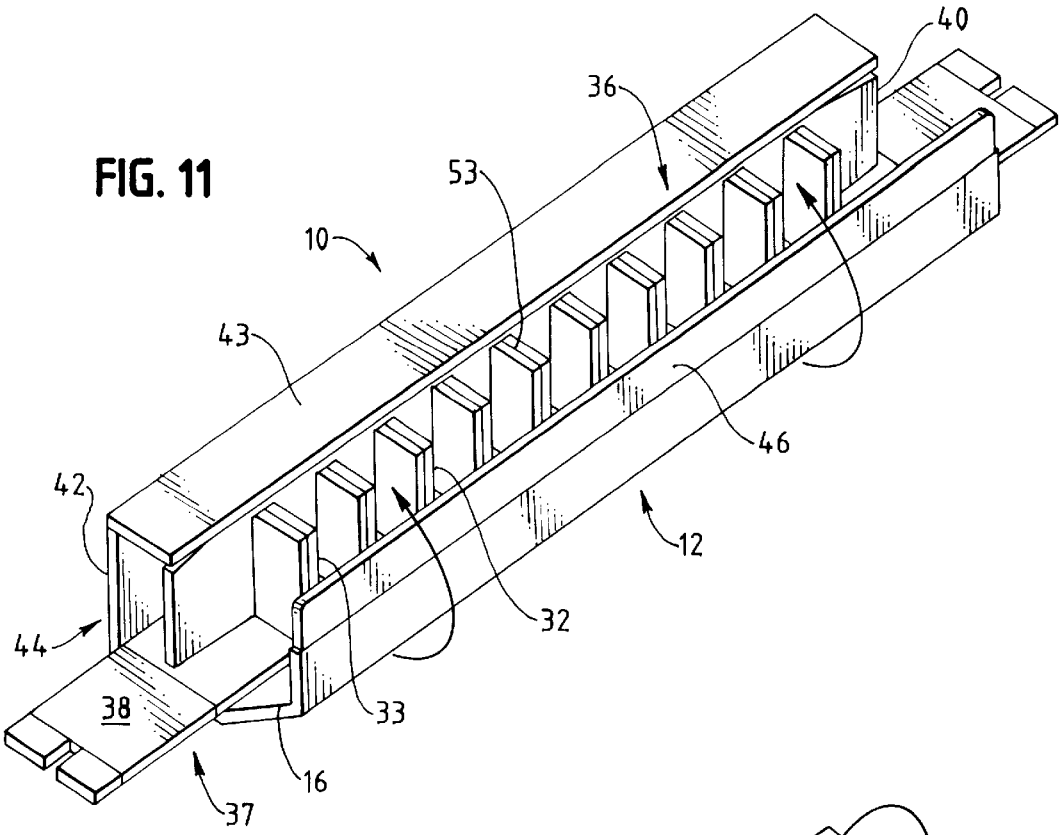
Figure 12:
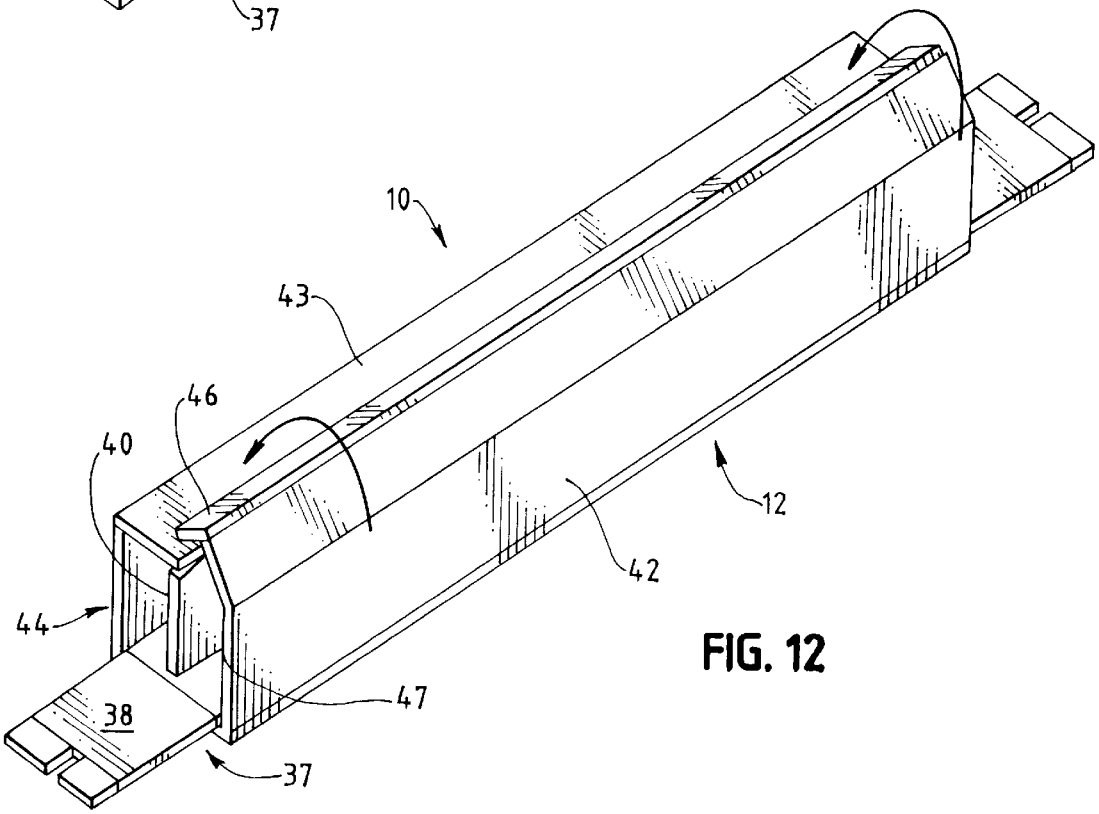
FIG. 12 is a perspective view showing a locking side panel opposite the reinforcing side panel being inserted adjacent the rib.

After they are assembled to the rib 40, the support units 36 and 37 are rolled over to fold remaining panels 42 of the sheet 12 along the crease lines 16 in a wrapping relation (FIGS. 10–12). As will be appreciated, the width of each panel 42 corresponds to an associated edge of the partitions 32 and 33. Thus, as shown in FIGS. 11 and 12, the foregoing folding or rolling about the crease lines 16 results in an inherently strong enclosure 43 with an interior chamber 44, wherein each of the support partitions 32 and 33 substantially fills the cross-sectional area of the interior chamber 44 and the support surfaces 53 of the support units abut the outer sheet 12 to enhance the strength of the structure 10. The outer sheet 12 is also provided with a locking side flap 46 opposite the reinforcing rib 40, which is tucked into abutting relationship with the rib 40 as shown in FIG. 13.

Finally, as shown in FIGS. 13 and 14, end panels 38 are folded inward so that locking end flaps 26 may be inserted into the opposing end openings 47 of the enclosure 43 with end slots 24 receiving the ends of rib 40 and locking side flap 46. This allows box-like structure 10 to be completely closed so as to eliminate the leakage of liquid concrete into its interior.

Thus, an inherently strong, cellular box-like structure 10 is provided that can support a great deal of weight when concrete is poured thereon to create a void.

Preferably, the box-like structure 10 is manufactured to ISO 9001 Standards and is available in a wide variety of sizes, shapes and strengths to accommodate the desired void-forming application. For example, the box-like structure is preferably available in a "standard" strength having approximately 1200 PSF ultimate capacity, which is approved for a maximum beam/wall height of 8 feet, and an "extra" strength having approximately 2000 PSF ultimate capacity, which is approved for a maximum beam/wall height of 14 feet. It should be noted that an engineer's discretion may be substituted for the maximum beam/wall heights stated for each strength. The dimensions of the box-like structure itself can also vary depending on the particular application. For example, the standard and extra versions of the box-like structure 10 can have a width of 8, 9, 10 and 12 inches, and a height of 4, 6, 8, 10 and 12 inches.

In a preferred form of the invention, the box-like structure 10 is covered with a protective coating on each exterior surface to provide temporary protection prior to installation of the box-like structure 10 at the construction site. In case of extremely wet ground conditions, it may be desirable to cover the box-like structure 10 with a water resistant membrane. For example, the box-like structure 10 can be covered with a polyurethane coating, preferably about 4 millimeters thick, with overlapping joints where required. Where fitting is required, a desired area can be wrapped to prevent penetration of water from wet concrete.

Thus, a box-like structure is provided which is inherently strong and easy to assemble without glues or mechanical fasteners at a construction site or prior to delivery to the construction site. The strength of the corrugated paper and the orientation of the crease and slit score lines facilitates the unique folding action to allow quick and easy assembly of the partitions. The double-thickness walls of the partitions, combined with the flat support surfaces provided by the slit scoring, increase the vertical strength of the box-like structure to provide adequate support for a concrete formation.

From the foregoing, it will be observed that numerous modifications and variations can be effected without departing from the true spirit and scope of the novel concept of the present invention. It will be appreciated that the present disclosure is intended as an exemplification of the invention, and is not intended to limit the invention to the specific embodiment illustrated. The disclosure is intended to cover by the appended claims all such modifications as fall within the scope of the claims.

What is claimed is:

1. A reinforced box-like structure for forming a void area in a concrete formation, comprising:

an enclosure defining an interior chamber;

a longitudinal rib extending in a normal direction from a wall of said enclosure into said interior chamber;

a plurality of interior support units attached to said longitudinal rib, each including a plurality of spaced apart support partitions extending transversely to said longitudinal rib and substantially filling a cross-sectional area of said interior chamber; and each of said support partitions including a double-thickness wall folded about slit scoring so as to define a flat support surface upon which said enclosure is supported so as to increase interior structural support thereof.

2. The structure of claim 1 wherein said enclosure defines a pair of opposing end openings and further comprising a pair of end panels, each of which engage said enclosure to cover said opposing end openings.

3. The structure of claim 2 further comprising a pair of end support units, one of each of which are attached to one of each of said end panels and each including an end support partition transversely attached to said longitudinal rib and sized so as to substantially fill the cross-sectional area of said interior chamber.

4. The structure of claim 2 further comprising a pair of locking end flaps, one of each attached to one of each of said end panels and each including an end slot therein, said end flaps inserted through one of each of said end openings of said enclosure with said end slots engaged by said longitudinal rib.

5. The structure of claim 1 wherein said support units are provided separate from the enclosure prior to assembly and are removably attachable to said longitudinal rib.

6. The structure of claim 1 wherein said longitudinal rib has a plurality of slots formed therein for interconnection with the partitions of the support units.

7. The structure of claim 6 wherein each of said partitions has a slot formed therein for registering in interlocking relationship with corresponding slots in the longitudinal rib.

8. The structure of claim 1 wherein the enclosure is configured as a flat sheet prior to assembly, said flat sheet having parallel crease lines thereon to facilitate folding of the flat sheet into said enclosure.

9. The structure of claim 8 wherein the support units are attached to the rib, and subsequently rolled over to fold remaining panels of the enclosure along said crease lines in wrapping relation around said support units and a remaining locking side flap is inserted adjacent the rib.

10. A reinforced box-like structure for forming a void area in a concrete formation, comprising:

an enclosure having an interior chamber;

a longitudinal rib extending in a normal direction from a wall of said enclosure into said interior chamber;

an interior support unit formed of an interior piece that is separate from said enclosure having an inner layer and an outer layer, said outer layer of said interior piece having a plurality of parallel slits therethrough so as to define a plurality of parallel slit scores, said interior piece folded about said slit scores so as to define a plurality of support partitions each of which includes a double-thickness wall and defines a flat support surface;

each of said support partitions engaging said longitudinal rib transversely and sized so as to extend across said interior chamber both vertically and horizontally with said flat support surfaces abutting said enclosure;

whereby interior structural support of said enclosure is increased.

11. The structure of claim 10 wherein said enclosure defines a pair of opposing end openings and further comprising a pair of end panels, each of which engage said enclosure to cover said opposing end openings.

12. The structure of claim 11 further comprising a pair of end support units, one of each of which are attached to one of each of said end panels and each including an end support partition transversely attached to said longitudinal rib and sized so as to substantially fill the cross-sectional area of said interior chamber.

13. The structure of claim 11 further comprising a pair of locking end flaps, one of each attached to one of each of said end panels and each including an end slot therein, said end flaps inserted through one of each of said end openings of said enclosure with said end slots engaged by said longitudinal rib.

14. The structure of claim 10 wherein said support units are provided separate from the enclosure prior to assembly and are removably attachable to said longitudinal rib.

15. The structure of claim 10 wherein said longitudinal rib has a plurality of slots formed therein for interconnection with the partitions of the support units.

16. The structure of claim 15 wherein each of said partitions has a slot formed therein for registering in interlocking relationship with corresponding slots in the longitudinal rib.

17. The structure of claim 10 wherein the enclosure is configured as a flat sheet prior to assembly, said flat sheet having parallel crease lines thereon to facilitate folding of the flat sheet into said enclosure.

18. The structure of claim 17 wherein the support units are attached to the rib, and subsequently rolled over to fold remaining panels of the enclosure along said crease lines in wrapping relation around said support units and a remaining locking side flap is inserted adjacent the rib.

19. An assembly for forming a reinforced box-like structure that may be used to form a void area in a concrete formation, comprising:

a flat outer sheet having a plurality of parallel crease lines thereon and a side edge reinforcing panel adjacent one of said parallel crease lines so that it may be folded into a position generally normal to the flat sheet to define a longitudinal rib;

said longitudinal rib having a plurality of slots thereon extending generally perpendicular to said crease lines;

a plurality of flat interior pieces that are separate from said flat outer sheet, each having a plurality of parallel slit scores thereon, a plurality of transverse slits extending transversely across said slit scores and panel sections on each side of said slit scores so that when each of said flat interior pieces are folded about said slit scores, said panel sections move into a side by side relationship to define a plurality of support partitions which include double-thickness walls and define flat support surfaces and said transverse slits fold in half to form unitary insertion slots in said partitions;

whereby the insertion slots in the partitions may be interlocked with corresponding slots on the rib so that said partitions extend transversely relative to said rib so that said outer sheet may be wrapped about said partitions so that said flat support surfaces abut said outer sheet.

20. The assembly of claim 19 wherein the parallel crease lines of said flat outer sheet define three adjacent side panels, two of which are bordered by first and second half-side panels with said first said half-side panels bordered by a locking side flap and said second half-side panel bordered by said side edge reinforcing panel so that said locking side flap and said longitudinal rib engage when said outer sheet is wrapped about said partitions.

21. The assembly of claim 19 wherein the flat interior pieces each include at least one pair of parallel crease lines that define at least one interior bridge panel that extends between said support partitions when each of said flat interior pieces is folded.

22. The assembly of claim 19 further comprising a flat end piece having a slit score thereon, a transverse slit extending transversely across said slit score and panel sections on each side of said slit score so that when said flat end piece is folded about said slit score, said panel sections move into a side by side relationship to define an end support partition which defines a flat support surface and said transverse slit folds in half to form a unitary insertion slot in said end support partition and one of said panel sections being connected to an end bridge panel via a crease line with said end bridge panel being connected to an end panel via a crease line;

whereby the unitary insertion slot of said end support partition may be inserted into a slot of said longitudinal rib so that said end panel may be folded to cover an end opening after said outer sheet is wrapped about said support partitions.

23. A method of making a reinforced box-like structure for forming a void area in a concrete formation, comprising:

providing a flat outer sheet having a plurality of parallel crease lines thereon and a side edge reinforcing panel, said reinforcing panel having a plurality of slots thereon extending generally perpendicularly relative to said crease lines;

providing a plurality of flat interior pieces that are separate from the flat outer sheet, each having a plurality of parallel slit scores thereon and a plurality of transverse slits extending transversely across said slit scores;

folding each flat interior piece such that panel sections on each side of said slit scores move into side by side relationship to define a plurality of support partitions, each featuring a double-thickness wall and a flat support surface, whereby the transverse slits on said slit scores are folded in half to form unitary insertion slots in said partitions and whereby each folded interior piece defines an interior support member;

folding the side edge reinforcing panel into a position generally normal to the flat sheet to define a longitudinal rib;

attaching said support units to the longitudinal rib by registering the insertion slots in the partitions in interlocking relationship with corresponding slots on the rib, wherein said partitions extend transversely relative to said rib; and folding remaining panels of the outer sheet along said crease lines in wrapping relation around said support units, thereby defining an enclosure with an interior chamber, each of said support partitions extending across said interior chamber both horizontally and vertically with said flat support surfaces abutting said enclosure to increase the strength of the structure.

24. The method of claim 23 further comprising the steps of:

providing a pair of end panels; and engaging said enclosure with said end panels to cover opposing end openings defined by said enclosure.

25. A reinforced box-like structure for forming a void area in a concrete formation, comprising:

an enclosure having an interior chamber and defining a pair of opposing end openings;

a longitudinal rib extending in a normal direction from a wall of said enclosure into said interior chamber;

a pair of end panels, each of which engage said enclosure to cover said opposing end openings;

a pair of locking end flaps, one of each attached to one of each of said end panels and each including an end slot therein, said end flaps inserted through one of each of said end openings of said enclosure with said end slots engaged by said longitudinal rib;

an interior support unit formed of an interior piece having an inner layer and an outer layer, said outer layer of said interior piece having a plurality of parallel slits therethrough so as to define a plurality of parallel slit scores, said interior piece folded about said slit scores so as to define aplurality of support partitions each of which defines a flat support surface;

each of said support partitions engaging said longitudinal rib transversely and sized so as to substantially fill a cross-sectional area of said interior chamber with said flat support surfaces abutting said enclosure;

whereby interior structural support of said enclosure is increased.

26. An assembly for forming a reinforced box-like structure that may be used to form a void area in a concrete formation, comprising:

a flat outer sheet having a plurality of parallel crease lines thereon and a side edge reinforcing panel adjacent one of said parallel crease lines so that it may be folded into a position generally normal to the flat sheet to define a longitudinal rib;

said longitudinal rib having a plurality of slots thereon extending generally perpendicular to said crease lines;

a plurality of flat interior pieces each having a plurality of parallel slit scores thereon, a plurality of transverse slits extending transversely across said slit scores and panel sections on each side of said slit scores so that when said flat interior pieces are folded about said slit scores, said panel sections move into a side by side relationship to define a plurality of support partitions which define flat support surfaces and said transverse slits fold in half to form unitary insertion slots in said partitions so that the insertion slots in the partitions may be interlocked with corresponding slots on the rib so that said partitions extend transversely relative to said rib so that said outer sheet may be wrapped about said partitions so that said flat support surfaces abut said outer sheet;

a flat end piece having a slit score thereon, a transverse slit extending transversely across said slit score and panel sections on each side of said slit score so that when said flat end piece is folded about said slit score, said panel sections move into a side by side relationship to define an end support partition which defines a flat support surface and said transverse slit folds in half to form a unitary insertion slot in said end support partition and one of said panel sections being connected to an end bridge panel via a crease line with said end bridge panel being connected to an end panel via a crease line so that the unitary insertion slot of said end support partition may be inserted into a slot of said longitudinal rib so that said end panel may be folded to cover an end opening after said outer sheet is wrapped about said support partitions.

27. A method of making a reinforced box-like structure for forming a void area in a concrete formation, comprising:

providing a flat outer sheet having a plurality of parallel crease lines thereon and a side edge reinforcing panel, said reinforcing panel having a plurality of slots thereon extending generally perpendicularly relative to said crease lines;

providing a plurality of flat interior pieces each having a plurality of parallel slit scores thereon and a plurality of transverse slits extending transversely across said slit scores;

folding each flat interior piece such that panel sections on each side of said slit scores move into side by side relationship to define a plurality of support partitions, each featuring a flat support surface, whereby the transverse slits on said slit scores are folded in half to form unitary insertion slots in said partitions and whereby each folded interior piece defines an interior support member;

folding the side edge reinforcing panel into a position generally normal to the flat sheet to define a longitudinal rib;

attaching said support units to the longitudinal rib by registering the insertion slots in the partitions in interlocking relationship with corresponding slots on the rib, wherein said partitions extend transversely relative to said rib;

folding remaining panels of the outer sheet along said crease lines in wrapping relation around said support units, thereby defining an enclosure with an interior chamber, each of said support partitions substantially filling a transverse cross-sectional area of said interior chamber with said flat support surfaces abutting said enclosure to increase the strength of the structure;

providing a pair of end panels; and engaging said enclosure with said end panels to cover opposing end openings defined by said enclosure.

* * * * *